United States Patent [19]

Scherbing

[11] 4,147,905

[45] Apr. 3, 1979

[54] SLEEVE AND TERMINAL HOLDER ASSEMBLY FOR AN AXIAL SPLIT-PIN TUMBLER-TYPE SWITCH LOCK MECHANISM

[75] Inventor: Frank J. Scherbing, Chicago, Ill.

[73] Assignee: Chicago Lock Co., Chicago, Ill.

[21] Appl. No.: 797,624

[22] Filed: May 17, 1977

[51] Int. Cl.[2] ..... H01H 9/28; H01H 27/00

[52] U.S. Cl. ..... 200/44; 70/363

[58] Field of Search ..... 200/44; 70/363, 237

[56] References Cited

U.S. PATENT DOCUMENTS

| | | | |
|---|---|---|---|
| 1,809,368 | 6/1931 | Winning | 200/44 X |
| 2,630,502 | 3/1953 | Hept | 200/44 |
| 3,102,412 | 9/1963 | Christopher | 70/363 |
| 3,639,708 | 2/1972 | Wolniak et al. | 200/44 |
| 3,813,906 | 6/1974 | Kerr | 70/363 |
| 3,916,657 | 11/1975 | Steinbach | 70/363 X |

*Primary Examiner*—Herbert F. Ross

*Attorney, Agent, or Firm*—Norman H. Gerlach

[57] ABSTRACT

A sleeve and terminal holder assembly for an axial split-pin tumbler-type switch lock mechanism, such mechanism including a lock cylinder, and an operating part disposed forwardly within the cylinder and rotatable therein, the operating part including a cylindrical head and a shaft having a reduced diameter extending rearwardly therefrom, the head having longitudinal tumbler bores extending therethrough and disposed radially outwardly of the shaft, the assembly comprising a sleeve adapted to be disposed within the cylinder adjacent to the operating part head and with the shaft extending therethrough, the sleeve having longitudinal tumbler bores therein adapted for alignment with the head bores for receiving split-pin tumblers in aligned bores, a holder for electrical terminals spaced rearwardly from the sleeve, and means joining the sleeve to the holder in an assembly adapted for insertion in the cylinder as a unit.

15 Claims, 14 Drawing Figures

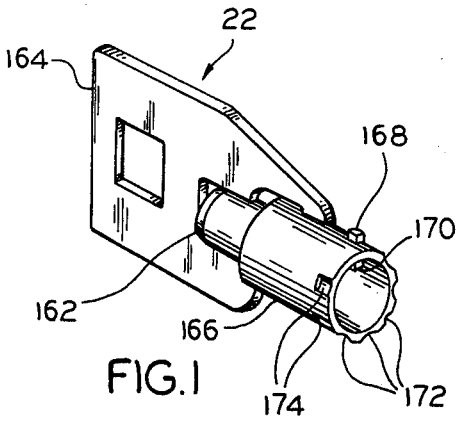
FIG.1
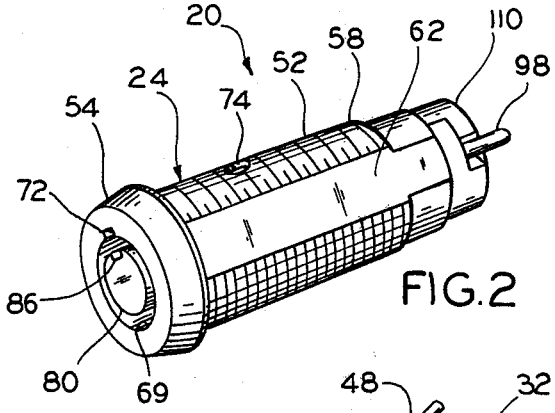
FIG.2
FIG.3
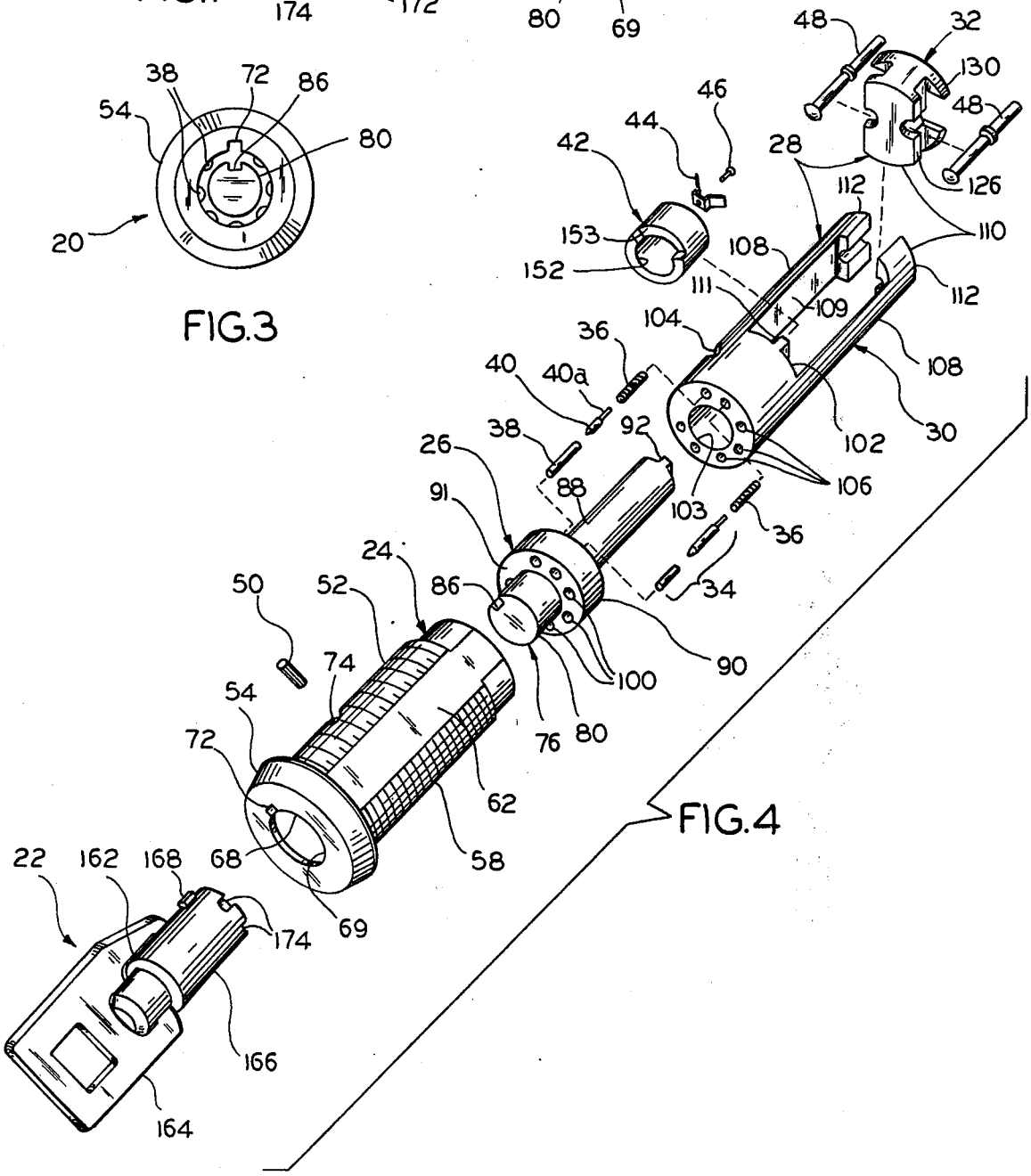
FIG.4

SLEEVE AND TERMINAL HOLDER ASSEMBLY FOR AN AXIAL SPLIT-PIN TUMBLER-TYPE SWITCH LOCK MECHANISM

BACKGROUND OF THE INVENTION

This invention relates to axial split-pin tumbler-type switch lock mechanisms, such mechanisms including a lock cylinder, a rotatable operating part, a sleeve, and a holder for electrical terminals. More particularly, the invention pertains to a sleeve and terminal holder assembly adapted for insertion in the lock cylinder as a unit.

U.S. Pat. No. 3,813,906 discloses an axial split-pin tumbler-type switch lock mechanisms of the type with which the present invention is concerned. The lock of the patent is in commercial use. It will be noted, however, that the provision of the switch components of the lock mechanism entails the use of a sizable number of individual parts It would be desirable if the mechanism could be simplified.

SUMMARY OF THE INVENTION

The present invention provides a sleeve and terminal holder assembly for an axial split-pin tumbler-type switch lock mechanism, which assembly serves to reduce the number of parts employed in the mechanism. In particular, the sleeve part of the mechanism is joined to a terminal holder in an assembly adapted for insertion in the lock cylinder as a unit. An inner cylinder part and a coupling employed in the prior switch lock mechanism are dispensed with, and in the preferred illustrative embodiment, additional parts are dispensed with.

Cost savings are realized in a number of ways: materials cost, machining operations, and assembly labor are reduced. A crimping operation to hold the switch components in place is eliminated. Inventory costs are reduced.

The invention in its broader aspects provides a sleeve and terminal holder assembly for an axial split-pin tumbler-type switch lock mechanism, such mechanism including a lock cylinder, and an operating part disposed forwardly within the cylinder and rotatable about a longitudinal axis extending between front and rear ends of the part, the operating part including a cylindrical head and a shaft having a reduced diameter with respect to the head and extending rearwardly therefrom, the head having longitudinal tumbler bores extending therethrough and disposed radially outwardly of the shaft, said assembly comprising: a sleeve adapted to be disposed within the cylinder adjacent to the operating part head and with the shaft extending therethrough, the sleeve having longitudinal tumbler bores therein adapted for alignment with the head bores for receiving split pin tumblers in aligned bores, a holder for electrical terminals spaced rearwardly from the sleeve, and means joining the sleeve to the holder in an assembly adapted for insertion in the cylinder as a unit.

In a preferred embodiment of the invention, the holder comprises spaced apart first seat portions and a discrete body member connectable to the first seat portions therebetween and including second seat portions adapted to mate with respective first seat portions for securing the electrical terminals therebetween, and the joining means comprise arms extending longitudinally from the sleeve and integral therewith and with respective ones of the first seat portions. It is further preferred that the sleeve, the joining means, and the first seat portions together comprise a first one-piece molded plastic part, and the body member comprise a second one-piece molded plastic part.

BRIEF DESCRIPTION OF THE DRAWINGS

The attached drawings illustrate preferred embodiments of the lock mechanism of the invention, without limitation thereto. In the drawings, like elements are identified by like reference symbols in each of the views, and:

FIG. 1 is a perspective view of a key which cooperates with the lock mechanism of FIG. 2;

FIG. 2 is a front perspective view of a lock mechanism or lock, in accordance with the invention;

FIG. 3 is a front end elevational view of the lock mechanism;

FIG. 4 is an exploded perspective view of the lock mechanism and key;

DESCRIPTION OF THE PREFERRED EMBODIMENTS

Figure 5:
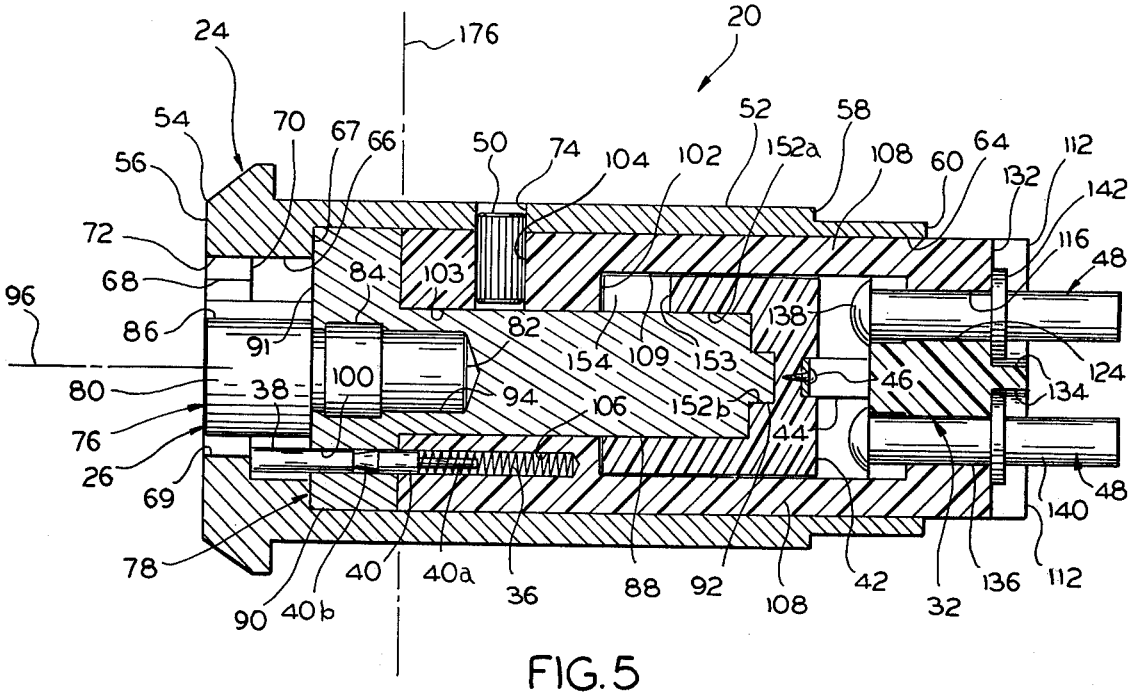
FIG. 5 is an enlarged longitudinal sectional view of the lock mechanism, shown with the switch open.

Referring to the drawings, particularly FIGS. 1–4, an axial split-pin tumbler-type switch lock mechanism or lock 20 is employed with a tubular key 22. The locking components of the lock mechanism and the key are similar to the corresponding structures illustrated in U.S. Pat. No. 3,102,412. The locking plate or cam structure of the patent is, however, replaced by switch components. The switch components are generally similar to switch components of the lock mechanism illustrated in U.S. Pat. No. 3,813,906. However, the number of parts in the lock mechanism 20 is reduced with respect to the number of parts in the lock mechanism of the latter patent, and parts are unified, preferably with a change of material, as described hereinafter.

The lock mechanism 20 includes, as its principal parts, a lock cylinder 24, an operating part 26, and a sleeve and terminal holder assembly 28, the assembly including as discrete components thereof a unitary subassembly 30 and a holder body member 32. The lock mechanism 20 also includes a plurality of tumblers 34, which are seven in number, and a like number of coil compression tumbler springs 36, but two sets of tumblers and springs being illustrated in FIG. 4. Each tumbler is composed of a driver element or pin 38 and a follower or locking element or pin 40 having a stem 40a. The lock mechanism further includes a conductor carrier 42, an electrical conductor 44, a mounting screw 46 for the conductor, and a pair of electrical terminals 48. The components of the lock mechanism 20 are secured together by means of a mounting pin 50.

Figure 6:
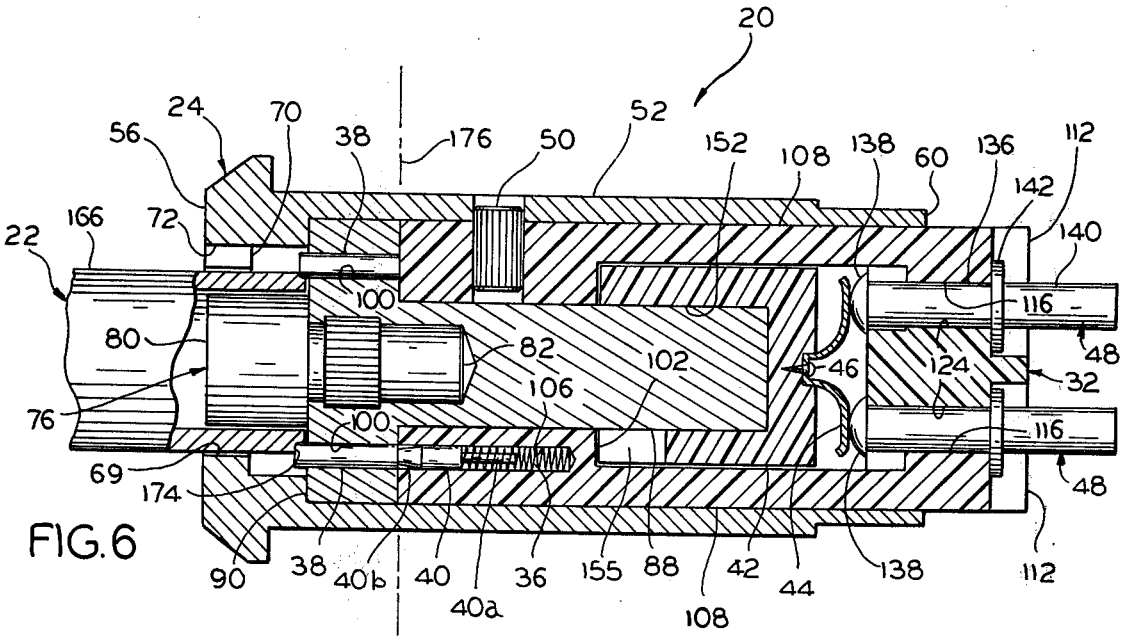
FIG. 6 is a view similar to FIG. 5 but illustrating a portion of the key of FIG. 1 engaging the lock tumblers to free an operating part of the mechanism for rotation, and with the operating part rotated to close the switch.

Referring to FIGS. 4 to 6, in particular, the lock cylinder 24 includes a generally cylindrical body 52 and a frusto-conical head 54 of greater diameter integral with the body at the front end 56 of the lock cylinder. The body 52 is provided with a raised threaded section 58 extending rearwardly from the head 54 and terminating short of the rear end 60 of the lock cylinder. A longitudinal flat 62 is provided on the body 52. The foregoing structure serves for mounting the lock mechanism in a door or wall panel or the like and in a conventional manner. Thus, for example, the body 52 may be inserted in a similarly shaped opening in such a panel, with the head 54 adjacent to one side of the panel. The lock cylinder 24 is secured in place by a nut, not shown, which engages the threaded section 58 and is tightened against the opposite side of the panel.

The cylinder body 52 has a longitudinal cylindrical bore 64 extending forwardly from its rear end 60. A second longitudinal cylindrical bore 66 is provided in the body 52 and the head 54 adjacent to the front end 56. A rearwardly facing annular retention shoulder 67 extends between the bores 64 and 66 where they terminate adjacent to each other. An annular closure flange 68 extends radially inwardly from the head 54 at the front end 56 of the lock cylinder, and it defines a circular key opening 69. The flange 68 forms a rearwardly facing annular shoulder 70 on the wall of the front bore 66. A key guide notch 72 extends radially outwardly from the inner edge of the flange 68. A radial hole 74 is provided in the body 52, and it serves to receive the mounting pin 50.

The operating part 26 in the illustrative embodiment includes a post unit 76 and a spindle unit 78. The post unit 76 includes a generally cylindrical key guide post 80 and an integral coaxial generally cylindrical shank 82 of reduced diameter, having a slightly enlarged knurl ring 84 therearound. The post 80 has a longitudinal drive groove 86 along the side thereof, and otherwise has a smooth cylindrical outer surface.

The spindle unit 78 includes a cylindrical lock shaft 88 and a coaxial cylindrical head 90 of greater diameter integral with the front end of the shaft. The rear end of the shaft 88 is reduced to provide a rearwardly projecting generally rectangular carrier mounting lug 92. The spindle head 90 has a planar front face 91 which is perpendicular to the longitudinal axis of the spindle unit 78. An annular series of longitudinal cylindrical tumbler bores 100 extends through the head 90, there being seven such bores having the same diameter in the illustrative embodiment. The bores 100 are spaced radially outwardly from the post 80 and at angles of 45° from each other, except for a 90° spacing between two of the bores.

A cylindrical blind bore 94 extends axially through the spindle head 90 and into the shaft 88, and it receives the post unit 76 therein, with the knurl ring 84 providing a tight drive fit. The post unit 76 and the spindle unit 78 thus are rigidly fixed relative to each other in the operating part 26. In the illustrative embodiment, the post unit 76 may be constructed of a very hard metal, to thwart attempts to drill through the lock in this area. Alternatively, the operating part 26 may be constructed in other ways, with any of the post 80, the shaft 88, and the spindle head 90 constructed separately or integrally with some or all of the remaining components, as most desirable for manufacture and intended use.

The operating part 26 is inserted in the lock cylinder 24 from the rear end 60 of the latter, and is retained therein by the retention shoulder 67, which is adjacent to the front face 91 of the spindle head 90. The key guide post 80 is received centrally in the key opening 69 and spaced from the surrounding closure flange 68 equidistantly therearound. The front face of the post 80 and the front face of the cylinder head 54 lie approximately in the same transverse plane. The operating part 26 is rotatable in the cylinder 24 about the longitudinal axis 96 of the part, which axis also is the longitudinal axis of the cylinder. The tumbler bores 100 are disposed at equal radii from the axis 96, and with the operating part 26 in the lock cylinder 24, the longitudinal axes or centers of the bores 100 lie approximately along the inner edge of the closure flange 68 when viewed from the front of the lock mechanism 20, as illustrated in FIG. 3.

The sleeve and terminal holder assembly 28 is of generally cylindrical configuration, having an outside diameter approximately the same as but slightly smaller than the diameter of the rear cylinder bore 64. The subassembly 30 includes a cylindrical tubular sleeve or sleeve portion 102 at the front end thereof, having an axial longitudinal bore 103 of diameter slightly greater than the diameter of the lock shaft 88, and a radial mounting bore 104 in its wall. As described hereinafter, the assembly 28 is received in the lock cylinder 24 with the sleeve 102 adjacent to the spindle head 90 and the shaft 88 received in the sleeve bore 103. The sleeve 102 is coaxial with the lock cylinder 24 and the operating part 26 when the parts are assembled, having the same longitudinal axis 96. An annular series of longitudinal cylindrical tumbler blind bores 106 is provided in the sleeve 102. The sleeve bores 106 have the same diameters, spacing, and radial distance from the axis 96 as the spindle head bores 100, so that the two series of bores may be placed in longitudinal alignment or register.

A pair of diametrically opposed spaced arms 108 extend rearwardly from the sleeve 102 integrally therewith. The arms are rounded transversely, corresponding to sections of a cylinder, and have spaced parallel flat inner surfaces 109. A wedge-shaped stop lug 111 also extends rearwardly from the sleeve 102 integrally therewith, between the arms 108. The arms 108 join the sleeve 102 to a terminal holder 110 (FIG. 4), which includes the body member 32 and a pair of diametrically opposed spaced parallel first seat portions 112. The first seat portions 112 are integral with the rear ends of respective arms 108.

Figure 8:
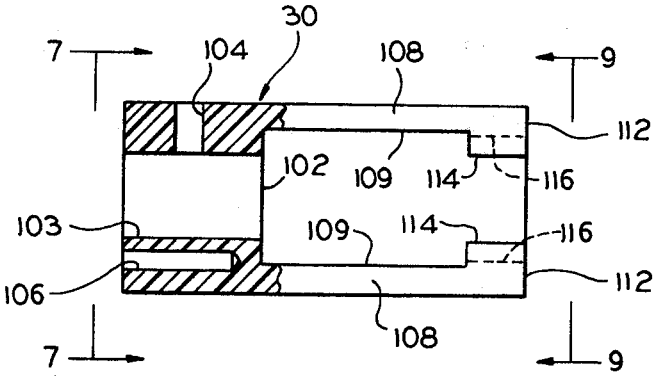
Figure 10:
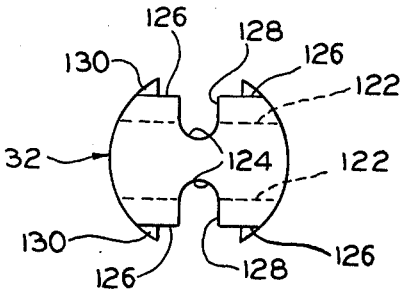
FIGS. 10–12 are, respectively, front end elevational, side elevational, and rear end elevational views of the remaining part of the assembly, on the scale of FIGS. 7–9.
Figure 9:
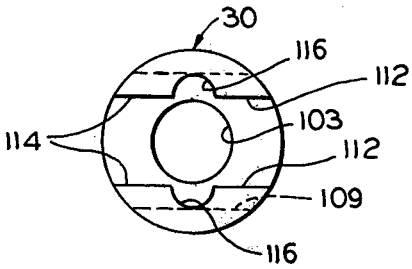
Figure 11:
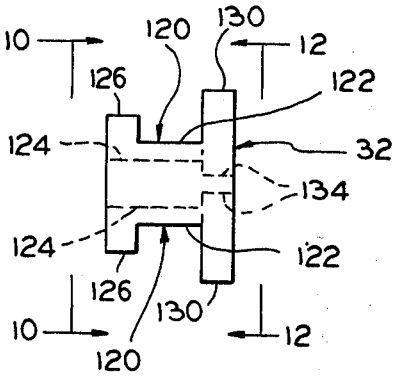
Figure 12:
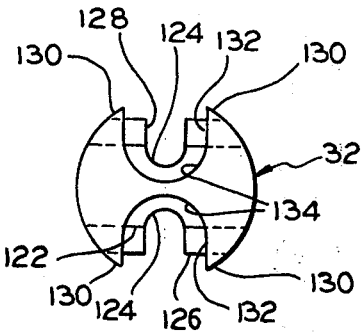

Referring to FIGS. 4, 8 and 9, the first seat portions 112 constitute arcuate portions of a cylinder, as subtended by chords, so as to provide spaced parallel flat inner engagement surfaces 114. Longitudinal semicylindrical seating grooves 116 are provided in the centers of the respective engagement surfaces 114. The first seat portions 112 extend radially inwardly from the arms 108, to provide interlocking means for connection to the body member 32, as subsequently described.

Referring to FIGS. 4 and 10–12, the body member 32 mates with the first seat portions 112 to provide a generally cylindrical terminal holder 110. The body member 32 includes on opposite sides thereof a pair of second seat portions 120, having flat parallel oppositely facing outer engagement surfaces 122 each provided with a central longitudinal semi-cylindrical seating groove 124. The width of the body member between its engagement surfaces 122 is approximately equal to the distance between the engagement surfaces 114 of the seat portions 112.

Flanges 126 extend laterally outwardly in opposite directions from the engagement surfaces 122 at the front or inner end of the body member 32. The width of the body member 32 between the outer edges 127 of the flanges 126 is approximately equal to the distance between the flat surfaces 109 of the arms 108 of the sub-assembly 30. Radial slots 128 in the flanges 126 register with the seating grooves 124 in the second seat portions 120.

The rear or outer end of the body member 32 is provided with arcuate flanges 130 extending laterally outwardly from the engagement surfaces 122. Radial slots 132 in the flanges 130 register with semi-cylindrical receiving grooves 134 in the rear end of the body member, which latter grooves are coaxial with and of greater diameter than the seating grooves 124.

Referring to FIGS. 4–12, the body member 32 is assembled with the first seat portions 112 to form the terminal holder 110 by moving the body member laterally into engagement with the first seat portions. The first seat portions 112 are received between the front and rear flanges 126 and 130 of the body member, whereby the parts are interlocked to secure them against relative longitudinal movement. The engagement surfaces 114 on the first seat portions 112 abuttingly engage the engagement surfaces 122 on the second seat portions 120, with the seating grooves 116 and 124 on opposite sides of the body member 32 forming cylindrical holes in the assembled holder 110.

Figure 13:
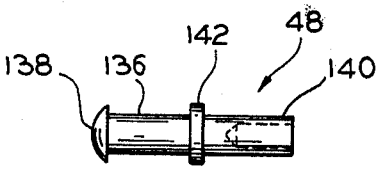
FIG. 13 is a side elevational view of an electrical terminal employed in the embodiment of the lock mechanism illustrated in FIGS. 2–6.

The terminals 48 employed in the illustrative lock mechanism 20 are known as solder type terminals. Referring to FIG. 13, in particular, each of the electrical terminals 48 includes as integral components thereof, a cylindrical mounting portion 136 having a rounded contact head 138 of enlarged diameter on the normally inner end thereof, a tubular connecting portion 140 forming the normally outer end of the terminal 48, and an annular retention flange 142 extending outwardly around the juncture of the mounting portion 136 and the connecting portion 140. In use, a wire is soldered to the connecting portion 140 of each terminal, and the wires complete an electrical circuit to equipment or a device to be controlled by operation of the lock mechanism 20.

Figure 14:
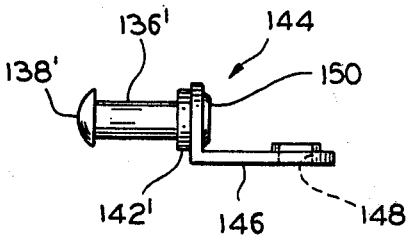
FIG. 14 is a side elevational view of an electrical terminal which may be employed alternatively in the lock mechanism.

Alternatively, other types of terminals may be employed in place of the solder type terminal 48, such as the screw type electrical terminal 144 illustrated in FIG. 14. The screw type terminal 144 is constructed with the same mounting portion 136', contact head 138' and retention flange 142' as the parts of the solder type terminal 48 which bear the same numbers. An angular plate member 146 having a threaded opening 148 adjacent to an outer end thereof is secured to the mounting portion 136' and adjacent to the retention flange 142' by a short tubular connecting portion 150 integral with the mounting portion 136', which is inserted through a corresponding opening in the plate member and peened. A wire to electrical equipment controlled by the lock mechanism 20 may be fastened to the terminal 144 by means of a screw, not illustrated, which is engaged in the threaded opening 148.

The solder type terminals 48 are mounted in the holder 110 by first seating their mounting portions 136 in the seating grooves 124 of the body member 32, with the contact head 138 of each terminal extending over the front end surface of the body member in engagement therewith, as illustrated in FIGS. 5 and 6. The retention flange 142 of each terminal 48 is received in a slot 132 and registering receiving groove 134 at the rear end of the body member, in engagement with the body member adjacent to a seating groove 124, also as illustrated in FIGS. 5 and 6.

With a pair of terminals 48 mounted on the body member 32 in this manner, the body member is moved laterally between the first seat portions 112, which extend between the body member flanges 126 and 130, with the engagement surfaces 114 and 122 in sliding interengagement. The first seat portions 112 are spread apart by the protruding terminal mounting portions 136 and snap in place thereover, with such mounting portions received in the seating grooves 116 in the first seat portions. At this time, the terminals 48 are secured between the mating first seat portions 112 and second seat portions 120, and the terminals are prevented from moving longitudinally by engagement of their contact heads 138 and retention flanges 142 with surfaces on the opposite ends of the holder 110. The body member 32 and the first seat portions 112 are in interlocking engagement preventing them from moving longitudinally relative to each other. The presence of the terminal mounting portions 136 in adjoining semi-cylindrical seating grooves 116 and 124 serves to prevent the body member 32 and the first seat portions 112 from moving laterally relative to each other. The screw type terminals 144 when employed in place of the solder type terminals 48 are mounted in the holder 110 in like manner, with the mounting portions 136' received in the adjoining seating grooves 116 and 124, with the contact heads 138' and the retention flanges 142' engaging opposite end surfaces of the holder.

Referring to FIGS. 4–6, 15 and 16, the conductor carrier 42 is constructed as a generally cylindrical block having a diameter slightly less than the distance between the inner surfaces 109 of the arms 108. A front side of the carrier 42 is provided with an axial recess 152 including a cylindrical front portion **152*a* having substantially the same diameter as the lock shaft 88, and a back portion 152*b* having substantially the same outline as the lug 92 on the rear end of the shaft 88. An arcuate recess 153 is formed in the front side of the carrier 42 around its periphery, and it is bounded by stop shoulders 154 and 155 on the carrier. The opposite, rear side of the carrier 42 is provided with a conductor-receiving recess 156 of generally rectangular configuration, having a screw hole 157** extending inwardly therefrom.

The conductor 44 is constructed in the form of a bent flat spring having a center portion 158 seated in the rear recess 156 in the carrier 42. In the illustrative embodiment, the spring is secured in place by the mounting screw 46, which is inserted through a hole in the center portion 158 and into the screw hole 157 in the carrier 42, in threaded engagement therewith.

In the preferred embodiments of the invention, each of the sub-assembly 30, the body member 32, and the carrier 42 is constructed as a one-piece molded plastic dielectric part, which may be constructed of reinforced plastic. The new structure represents a departure from the prior construction, wherein the sleeve thereof was constructed of metal. Not only is the requisite insulation provided, but considerable economies in manufacture are achieved, in addition to the lowered cost of the material of construction. Thus, the various bores, grooves and recesses may be formed by molding, and no drilling, particularly to form the tumbler bores 106, or reaming is required. Suitable plastic materials of construction include nylon, phenolic resins, and Teflon II, which may be reinforced with fibrous materials, such as glass fibers.

The tumblers 34 are of conventional construction, and they function in a conventional manner. The driver elements 38 are substantially cylindrical pins each having a diameter slightly smaller than the diameters of the tumbler bores 100 and 106. The follower elements 40 have cylindrical body portions of the same diameter as the driver elements 38, tapered head portions **40*b*, and the reduced diameter stems 40a, which receive the tumbler springs 36** therearound.

Referring to FIG. 1, the key 22 is a conventional structure, which includes a body 162 connected to a wing-type torque-applying or manipulating handle 164. The body includes a cylindrical tubular shank 166 having an inside diameter slightly greater than that of the guide post 80. Adjacent to the outer end of the shank 166, a longitudinally extending guide lug 168 extends radially outwardly from the shank, and a longitudinally extending drive lug 170 extends radially inwardly from the shank. Transversely arcuate grooves 172 are formed in the outer surface of the shank 166, and they extend longitudinally from the outer end thereof and terminate in bittings or shoulders 174. The grooves 172 and corresponding bittings 174 each are seven in number and spaced apart at angles of 45°, except for two of each, which are on opposite sides of the lugs and spaced apart 90°.

In assembling the lock mechanism 20, the sleeve and terminal holder assembly 28 having the terminals 48 mounted therein and the operating part 26 are assembled together, with the shaft 88 extending through the sleeve bore 103. The conductor carrier 42 having the conductor 44 secured thereto is mounted on the shaft 88 between the arms 108. The shaft 88 is received in the front recess 152 of the carrier 42 with the lug 92 on the shaft received in the back portion **152*b* of the recess, for direct drive of the carrier by the operating part 26, the carrier rotating therewith. The stop lug 111 on the sleeve 102 is received in the arcuate recess 153 in the carrier 42**.

Figure 15:
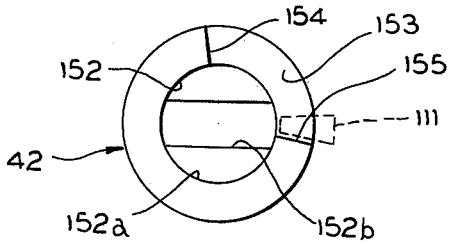
FIGS. 15 and 16 are, respectively, front and rear end elevational views of a conductor carrier in the lock mechanism.
Figure 16:
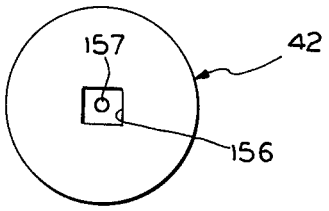
Figure 7:
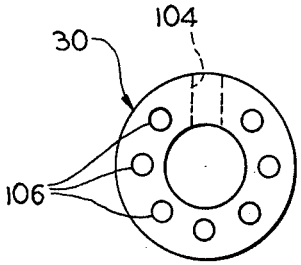
FIGS. 7–9 are, respectively, front end elevational, partly sectional and partly side elevational, and rear end elevational views of a part of a sleeve and terminal holder assembly in the lock mechanism, reduced in size with respect to FIGS. 5 and 6.

The carrier is rotatable over an angle of 90°, between the position illustrated in FIGS. 5 and 15, and the position illustrated in FIG. 6. In the respective positions, opposite sides of the stop lug 111 abuttingly engage the carrier shoulders 155 and 154, to limit rotation of the carrier. The conductor 44 rotates with the carrier 42. In a first position, illustrated in FIG. 5, the conductor 44 is separated from the terminal contact heads 138, so that the switch composed of the conductor and the terminals 48 is open. In a second position of the conductor 44, at 90° to the first position, illustrated in FIG. 6, the conductor bridges the contact heads 138, so that the switch is closed.

The tumbler springs 36 are seated in the sleeve bores 106 and receive the stems **40*a* of the follower elements 40 therein. The driver elements 38 and the follower elements 40 of the several tumblers 34 are inserted in aligned tumbler bores 100 and 106. The resulting assembly is inserted in the bore 64 of the lock cylinder 24, until the front face 91 of the spindle head 90 abuts against the rearwardly facing shoulder 67 in the lock cylinder, as illustrated in FIG. 5. The drive groove 86 in the post 80 is aligned radially with the key guide notch 72. The sleeve and terminal holder assembly 28 is fixedly secured to the lock cylinder 24 by the mounting pin 50, which is inserted in the mounting hole 74 in the cylinder and the registering mounting bore 104 in the sleeve, with a drive fit therein. The assembly 28 serves to retain the operating part 26 rotatably within the cylinder 24. The front face of the sleeve 102 adjoins the rear face of the spindle head 90 at a transverse interfacial plane 176**.

With the operating part 26 rotatable while the sleeve 102 is fixed, rotation of the operating part serves to rotate the tumbler bores 100 in the spindle head 90 into and out of longitudinal alignment or registerwith the tumbler bores 106 in the sleeve. In the initial, locked condition of the lock mechanism 20, illustrated in FIG. 5, the spindle bores 100 are in alignment with respective sleeve bores 106. The springs 36 yieldingly urge the tumbler elements 38 and 40 forwardly into positions wherein the interfacial plane 176 is bridged by the follower elements 40, to secure the operating part 26 and the sleeve 102 against relative rotation. The conductor carrier 42 and the conductor 44 then are held in the non-conducting position of the conductor illustrated in FIG. 5, being prevented from rotating.

At this time, the front ends of the driver elements 38 abut on the shoulder 70 formed by the closure flange 68 therearound, with a portion of each driver element 38 accessible to the key 22 through the key opening 69, as illustrated in FIGS. 3 and 5. The key 22 is inserted in the lock mechanism 20 for unlocking purposes by inserting the shank 166 in the key opening 69 and around the guide post 80. The guide lug 168 on the key is inserted in the guide notch 72 in the closure flange 68, and the drive lug 170 is inserted in the drive groove 86 in the post. The driver elements 38 of the tumblers 34 are received in part in the key grooves 172, and the front ends of the driver elements abuttingly engage the key bittings 174. Rearward movement of the key 22 moves the tumblers 34 in aligned tumbler bores 100 and 106 rearwardly, until the shank 166 of the key bottoms on the front face 91 of the spindle head 90, as illustrated in FIG. 6. At this time, the joints between the tumbler elements 38 and 40 coincide with the interfacial plane 176, and the guide lug 168 on the key is disposed rearwardly of the closure flange 68, so that the key may be turned to rotate the operating part 26 and thereby operate the lock mechanism 20. As described above, the operating part may be rotated 90° in the clockwise direction from the position of FIG. 5 to the position of FIG. 6 in the illustrative embodiment, thereby rotating the carrier 42 and the conductor 44 in the same direction and to the same extent and closing the switch.

The illustrative lock mechanism is constructed for a "one-way key pull", whereby the key may be inserted and withdrawn only in the initial, locked, open switch condition of the lock mechanism 20, illustrated in FIG. 5. When the lock mechanism 20 is in the closed switch position illustrated in FIG. 6 with the key inserted, the key cannot be removed from the lock mechanism, owing to engagement of the guide lug 168 on the key with the shoulder 70 formed by the flange 68. Alternatively, if desired, the lock mechanism 20 may be constructed for a "two-way key pull", by providing a second guide notch in the flange 68, like the illustrative notch 72, which second notch permits passage of the guide lug 168 therethrough for withdrawal of the key in the closed switch position of FIG. 6. Upon withdrawal of the key in the latter position, the tumbler elements 38 an 40 in the then-aligned tumbler bores 100 and 106 are urged by the tumbler springs 36 into locking positions bridging the interfacial plane 176, as illustrated in FIG. 5. Also, the open and closed switch positions may be transposed in such alternative construction, by appropriate alteration of the mounting of the conductor carrier 42. Additionally, the designs of the conductor carrier and the conductor, and the ways in which they are mounted may be varied while accomplishing the same objects.

The invention has been illustrated with reference to a two-part plug assembly of an operating part 26 having a spindle head 90 provided with tumbler bores 100, and a sleeve 102 provided with tumbler bores 106. It will be apparent that the invention is similarly applicable to plug assemblies having more than two parts provided with tumbler bores arranged for alignment. Thus, for example, the invention may be applied to lock mechanisms having three-part plug assemblies such as disclosed in Kerr U.S. Pat. No. 3,541,819 and Steinbach U.S. Pat. No. 3,916,657.

While preferred embodiments of the invention have been illustrated and described, and reference has been made to certain changes and modifications which may be made in the embodiments, it will be apparent to those skilled in the art that further changes and modifications may be made therein within the spirit and scope of the invention. It is intended that all such changes and modifications be included within the scope of the appended claims.

Having thus described the invention, what I claim as new and desire to secure by Letters Patent is:

1. A sleeve and terminal holder assembly for an axial split-pin tumbler-type switch lock mechanism, said lock mechanism including a lock cylinder, and an operating part disposed forwardly within said cylinder and rotatable about a longitudinal axis extending between front and rear ends of the part, said operating part including a cylindrical head and a shaft having a reduced diameter with respect to the head and extending rearwardly therefrom, said head having longitudinal tumbler bores extending therethrough and disposed radially outwardly of said shaft, said assembly comprising:

a sleeve adapted to be disposed within and fixedly secured to said cylinder adjacent to said operating part head and with said shaft extending therethrough, said sleeve having longitudinal tumbler bores therein adapted for alignment with said head bores for receiving split-pin tumblers in aligned bores, a holder for electrical terminals spaced rearwardly from said sleeve, and means fixedly joining said sleeve to said holder in an assembly adapted for insertion in said cylinder as a unit.

2. An assembly as defined in claim 1 and wherein said holder comprises spaced apart first seat portions and a discrete body member connectable to said first seat portions therebetween and including second seat portions adapted to mate with respective first seat portions for securing electrical terminals therebetween, and said joining means comprise arms extending longitudinally from said sleeve and integral therewith and with respective ones of said first seat portions.

3. An assembly as defined in claim 2 and wherein said sleeve, said arms, and said first seat portions together comprise a first one-piece molded plastic dielectric part, and said body member comprises a second one-piece molded plastic dielectric part.

4. An assembly as defined in claim 2 and wherein said first seat portions and said body member include interlocking means adapted for interconnecting the body member and the first seat portions by moving them laterally relative to each other to secure them against longitudinal movement relative to each other.

5. An assembly as defined in claim 4 and wherein said first and second seat portions define mating longitudinal semicylindrical grooves for receiving cylindrical terminal portions therein, whereby said body member with said terminal portions mounted in said grooves therein may be inserted laterally between said first seat portions into snap-fitting engagement therewith.

6. An assembly as defined in claim 5 and wherein said sleeve, said arms, and said first seat portions together comprise a first one-piece molded plastic dielectric part, and said body member comprises a second one-piece molded plastic dielectric part.

7. In an axial split-pin tumbler-type switch lock mechanism, said mechanism including a lock cylinder, and an operating part disposed forwardly with said cylinder and rotatable about a longitudinal axis extending between front and rear ends of the part, said operating part including a cylindrical head and a shaft having a reduced diameter with respect to the head and extending rearwardly therefrom, said head having longitudinal tumbler bores extending therethrough and disposed radially outwardly of said shaft, a sleeve and terminal holder assembly fixedly secured to said cylinder and comprising:

a sleeve disposed within and fixedly secured to said cylinder adjacent to said operating part head and with said shaft extending therethrough, said sleeve having longitudinal tumbler bores therein adapted for alignment with said head bores for receiving split-pin tumblers in aligned bores, a holder for electrical terminals spaced rearwardly from said sleeve, and means fixedly joining said sleeve to said holder in an assembly adapted for insertion in said cylinder as a unit.

8. A lock mechanism as defined in claim 7 and wherein said holder comprises spaced apart first seat portions and a discrete body member connectable to said first seat portions therebetween and including second seat portions adapted to mate with respective first seat portions for securing electrical terminals therebetween, and said joining means comprise arms extending longitudinally from said sleeve and integral therewith and with respective ones of said first seat portions.

9. A lock mechanism as defined in claim 8 and wherein said sleeve, said arms, and said first seat portions together comprise a first one-piece molded plastic dielectric part, and said body member comprises a second one-piece molded plastic dielectric part.

10. A lock mechanism as defined in claim 8 and wherein said first seat portions and said body member include interlocking means adapted for interconnecting the body member and the first seat portions by moving them laterally relative to each other to secure them against longitudinal movement relative to each other.

11. A lock mechanism as defined in claim 10 and wherein said first and second seat portions define mating longitudinal semicylindrical grooves for receiving cylindrical terminal portions therein, whereby said body member with said terminal portions mounted in said grooves therein may be inserted laterally between said first seat portions into snap-fitting engagement therewith.

12. A lock mechanism as defined in claim 11 and wherein said sleeve, said arms, and said first seat portions together comprise a first one-piece molded plastic dielectric part, and said body member comprises a second one-piece molded plastic dielectric part.

13. A lock mechanism as defined in claim 11 and including electrical terminals having cylindrical terminal portions mounted in said grooves, a conductor carrier disposed between said arms and associated with said shaft for rotation therewith, and an electrical conductor carried by said carrier for rotation therewith between a non-conducting position and a conducting position bridging said terminals.

14. A lock mechanism as defined in claim 13 and wherein said sleeve, said arms, and said first seat portions together comprise a first one-piece molded plastic dielectric part, said body member comprises a second one-piece molded plastic dielectric part, and said carrier comprises a third one-piece molded plastic dielectric part.

15. A lock mechanism as defined in claim 14 and wherein said first and third parts include means adapted for interengagement to limit the degree of rotation of the carrier.

* * * * *